United States Patent [19]

Walborn

[11] Patent Number: 4,640,388

[45] Date of Patent: Feb. 3, 1987

[54] ESCAPE DEVICE

[76] Inventor: John B. Walborn, Deer Path Run, Preston Rd., R.D. #1, Wernersville, Pa. 19565

[21] Appl. No.: 698,904

[22] Filed: Feb. 6, 1985

[51] Int. Cl.[4] ..... A62B 1/08

[52] U.S. Cl. ..... 182/231; 182/239; 182/57

[58] Field of Search ..... 182/231, 233, 234, 239, 182/236, 53, 57, 59, 5, 6, 7; 188/65.1, 65.2

[56] References Cited

U.S. PATENT DOCUMENTS

| | | | |
|---|---|---|---|
| 150,900 | 5/1874 | Silver et al. . | |
| 286,306 | 10/1883 | Johnson . | |
| 370,759 | 11/1887 | Barber | 182/236 |
| 388,491 | 8/1888 | Hill | 182/234 X |
| 764,339 | 7/1904 | Blumenthal | 182/233 |
| 831,462 | 9/1906 | Noyer | 182/6 |
| 1,243,118 | 10/1917 | Trivigino . | |
| 1,451,076 | 5/1923 | Loepfe . | |
| 1,490,524 | 4/1924 | Wood | 182/6 X |
| 1,500,943 | 7/1924 | Jolkovski . | |
| 2,116,427 | 5/1938 | Duncan . | |
| 2,717,139 | 9/1955 | Jewell | 182/57 X |
| 3,844,377 | 11/1974 | Wilkins | 182/6 |
| 3,946,989 | 3/1976 | Tsuda . | |
| 4,351,417 | 9/1982 | Seiz et al. | 188/65.1 X |
| 4,448,284 | 5/1984 | Ciabo | 182/239 X |
| 4,457,400 | 7/1984 | Donaldson et al. . | |
| 4,520,900 | 6/1985 | Orgeron | 182/233 X |

FOREIGN PATENT DOCUMENTS

| | | | |
|---|---|---|---|
| 18648 | 8/1914 | United Kingdom | 182/239 |
| 284420 | 2/1928 | United Kingdom . | |
| 1367632 | 9/1974 | United Kingdom . | |

*Primary Examiner*—Ramon S. Britts
*Assistant Examiner*—Karen J. Chotkowski
*Attorney, Agent, or Firm*—Oblon, Fisher, Spivak, McClelland, & Maier

[57] ABSTRACT

An escape device uses multiple discardable cable spools. The escape device casing is fitted to a window ledge by front and rear locking feet. A person attempting to escape uses hand grips to position himself below the roller spool for the cable and at a position spaced from the outside wall of the building. As he descends, his rate of descent is controlled by friction brakes within the casing. Upon reaching the ground, a door in the casing can be opened and the cable spool removed and replaced with a fresh cable spool, thus eliminating the necessity for rewinding the old cable.

13 Claims, 4 Drawing Figures

ESCAPE DEVICE

BACKGROUND OF THE INVENTION

The present invention is directed to a device for permitting the escape of persons from elevated locations. More particularly, the present invention is directed to a device for permitting the escape of persons from the upper stories of buildings, from bridges, from ski lifts, from amusement park rides, from work towers or from platforms.

Escape devices, such as fire escape devices for buildings, are well known in the art. Conventionally, such devices consist of a length of rope or cable wound on a spool mounted within a frame that includes speed limiting means such as brakes, clutches or speed governors. A person to be rescued attaches himself, or is attached, to a harness at the end of the cable or on the frame and jumps or falls from the building or other structure at a controlled speed due to the speed limiting means. However, conventional devices suffer from at least two types of shortcomings. First, they are either usable only once, or the cable must be rewound after each use, which is time consuming. Second, no rational means have been devised for arranging the escape device and the user so that the user can avoid bumping or crashing into the building while exiting or during descent.

For example, U.S. Pat. No. 4,457,400 to Donaldson et al discloses an emergency descent device which uses a planetary gear linkage and a centrifugal brake to control the descent speed. The device is attached directly to a harness and has a cable having an anchor at one end for securement to a building. Donaldson et al illustrates attachment to a projecting balcony in order to permit the user to drop from the building at a distance from the wall of the building.

However, if no such balcony happens to be available, difficulties arise during exit and descent from the building. For example, if it is necessary to break a window to gain access to the outside, the person attempting to escape (escaper) must crawl over the jagged glass of the broken window, without any buffer, while making an escape. Once the escaper has reached the exterior of the building, if he simply drops downward from the edge of the window the cable will extend downward along the surface of the building and the user will fall while bumping into any projections that may exist on the side surface of the building. Conversely, if the escaper leaps from the window with an outward velocity component, upon the tensioning of the cable 13, the reaction force of the cable will include a component which will cause the user to swing in an arc and forcefully crash against the side of the building. Neither result is desirable.

Donaldson et al proposes that each person in the building have his own fire escape device since the devices are not reusable.

U.S. Pat. No. 4,448,284 to Ciabo discloses another rescue device using friction braking and which is not reusable. Ciabo illustrates the rescue device as being attached to a large hook extending from the window. However, there is no reason to suppose that such a hook will be available, and if attached directly to the building, Ciabo will suffer from the same shortcomings as Donaldson et al with respect to the user contacting the building during descent.

An older design illustrated in U.S. Pat. No. 831,462 to Noyer discloses a fire escape device having several loops or belts attached to a single cable, as well as a crank handle by which the rope can be rewound for reuse. However, the logistical problems in trying to simultaneously secure several people to belts attached to a single rope, as well as the problem of the time necessary for rewinding the rope, make this design impractical.

SUMMARY OF THE INVENTION

It is an object of the present invention to provide an escape device providing a controlled rate of descent for an escaper.

It is a further object of the present invention to provide an escape device which can be used sequentially by several individuals in a short period of time.

It is a further object of the present invention to provide an escape device which can be rapidly secured to a building or other structure in such a manner that it will extend from the outer surface of the structure by a distance sufficient to prevent an escaper from contacting the building.

It is a final object of the invention to provide an escape device which is rapidly attachable to a building or other structure and includes means for permitting an escaper to transit from the interior of the structure to the exterior of the building and position himself to drop straight down without contacting the structure.

These objects are accomplished by a device including a casing containing a rotatably mounted spool. A cable is wound on the spool. The cable has one end secured to the spool and a second end having a thimble for attachment of the latch of a safety belt harness. The spool is rotatably mounted on a shaft which is connected through chains and sprockets to a brake device within the casing, for controlling the rate of unwinding of the cable from the spool.

According to the present invention, the shaft upon which the spool is mounted has one end fixed to one side wall of the casing. The opposite side wall of the casing has a door at a position corresponding to the spool. The door is sized and positioned so that the spool can be introduced and removed from the casing through the door. Moreover, the spool is held on the shaft by a hexagonal nut rotatably mounted on the shaft and engaged with a hexagonal enlargement of the axial bore of the spool. This engagement prevents relative rotation of the spool and nut, but permits the spool to be quickly slid off of the shaft. During operation, the spool is prevented from sliding off the shaft by the door. However, upon the opening of the door, the spool can rapidly be slid off the shaft with a single motion and replaced with a fresh spool having a fresh cable wound thereon.

Therefore, in use of the invention once a first individual has descended, the door is opened, the used spool is quickly slid off the shaft, a new spool is slid on the shaft and its cable prepared for unwinding, after which the door is closed and a new descent operation can begin.

According to a further feature of the invention, the casing is provided with cooperating locking feet which hold the casing above, for example, a window sill such that the end of the casing from which the cable extends is positioned at a distance beyond the exterior wall of the building. The rear locking feet which engage the inner walls of the building for example, are each adjustably mounted on a securement rod so that they can be adjusted for the thickness of the building wall. Moreover, hand grips extend outward from the outermost end of the casing. A user can grip the hand grips to prepare and hold himself in position when initiating a descent.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENT

Figure 1:
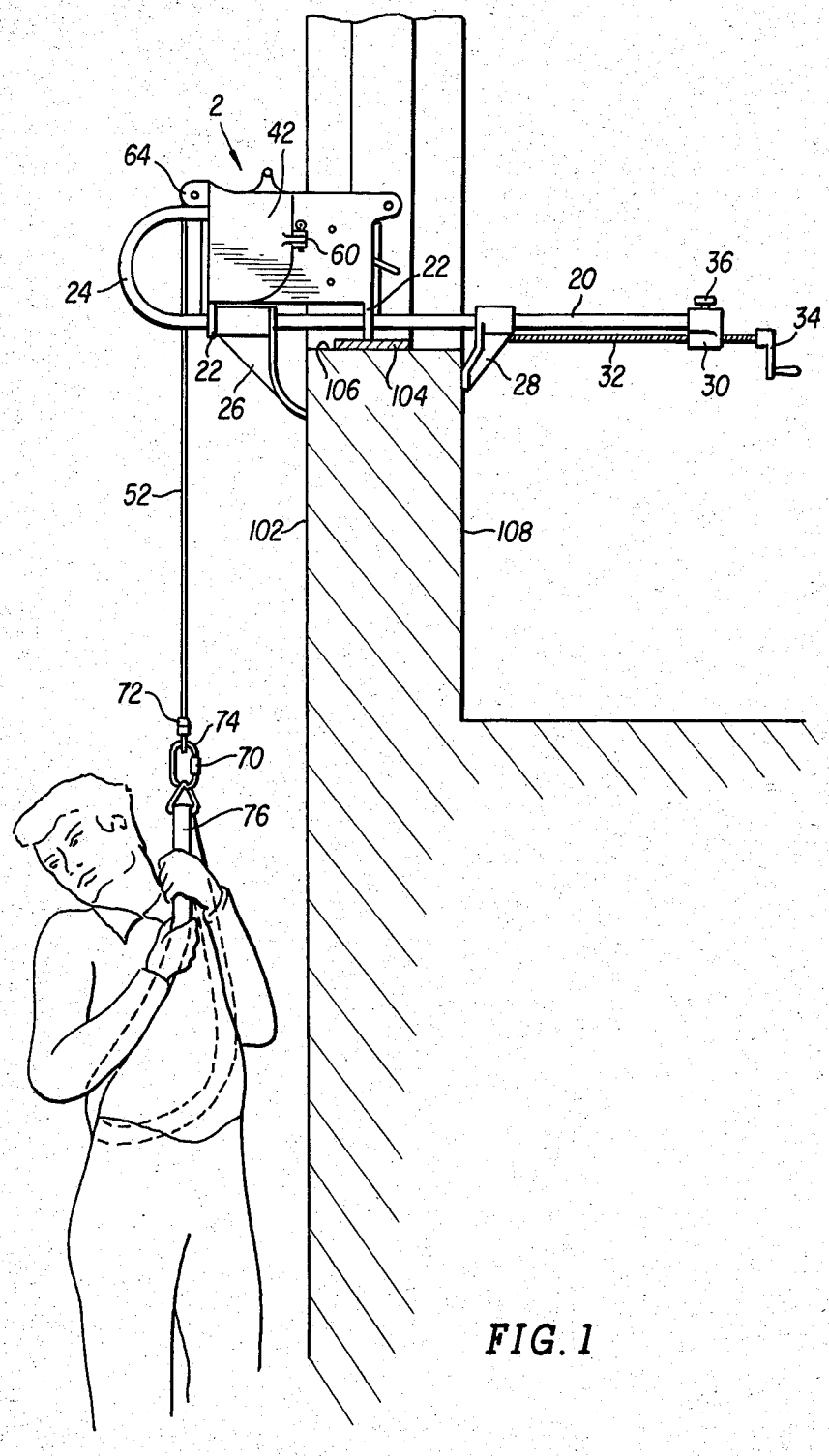
FIG. 1 is a side view of the escape device of the invention as attached to a building.
Figure 2:
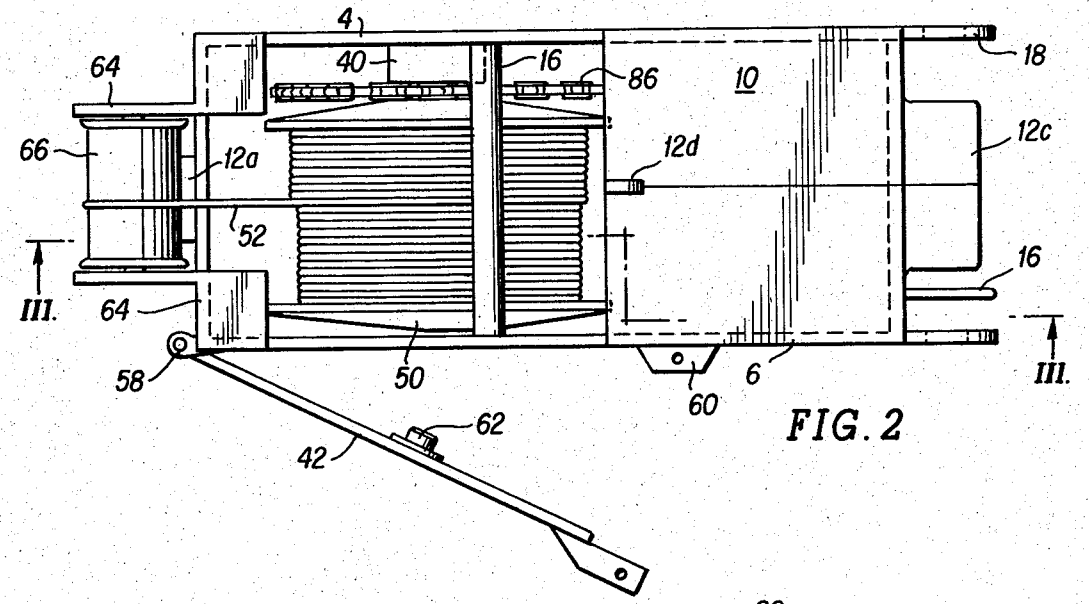
FIG. 2 is a top view of the casing of the escape device of the invention.

A preferred embodiment of the present invention will now be described with reference to the accompanying figures, wherein the same reference numeral will be used to designate the same, or corresponding, parts throughout the various views. The escape device will be described with reference to escape from a building, however it is usable with other structures.

The escape device of the present invention consists of a casing 2 which can be secured to the sill of a window, or any other horizontal surface having opposed vertical walls, such as the railing of a bridge. The casing 2 includes opposed parallel side walls 4 and 6, end walls 9 and 11, a bottom wall 8 and a top wall 10, the top wall covering only a portion of the top of the casing.

The casing is preferably formed from two cast aluminum halves which are secured to one another by screws, bolts or rivets at a flange joint 12*a*, 12*b*, 12*c* and 12*d* to form an integral unit.

A carrying handle 14 is fixed to the side wall 4 and extends to the side wall 6 while a carrying handle 16 is fixed to one of the end walls 11. Secondary attachment eyelets 18 are provided in flanges extending from each of the side walls 4 and 6.

Securement rods 20 are fixed in the casing via spring pinning on collars 22 adjacent the bottom of the side walls 4 and 6. Each securement rod terminates in a curved hand grip 24 which curves upward beyond the end wall 9. Only a single set of rods and hand grips are illustrated. The ends of the curved hand grips may or may not be further secured to the casing.

A front locking foot 26 is fixed to each securement rod and has an end extending downward. A rear locking foot 28 is slidably mounted on each securement rod. At the end of each securement rod is positioned a rear connecting piece 30. A threaded rod 32 is rotatably mounted on each rear locking foot and extends through a bore in each rear connecting piece 30. A handle 34 is fixed to the end of each threaded rod 32.

A threaded plunger 36 extends into each rear connecting piece 30 to the bore for the threaded rod 32. The threaded plunger includes threads which can engage with the threads in a threaded rod. Accordingly, the rotation of a threaded rod by the handle 34 will cause it to advance or retract along its length, thereby advancing and retracting the corresponding rear locking foot relative to its securement rod 20. The threaded plungers 36 are spring loaded (not shown) so that their threads will be retained in contact with the threads of the threaded rod. However, the threaded plungers can be depressed in opposition to the spring to eliminate engagement between their threads and threads of the threaded rod. This arrangement can be provided in a manner according to that shown in U.S. Pat. No. 150,900 to Silver, et al, which is herein incorporated by reference.

A spool shaft 38 extends transversely between the parallel walls 4 and 6. One end of the spool shaft is fixed to a boss 40 of the wall 4. The other end of the spool shaft is held in place by a hinged door 42 of the wall 6, in a manner which will be described.

A hex nut 44 is rotatably mounted on the spool shaft 38 and is welded to a spool sprocket 46 which is also mounted for rotation on the shaft 38. A collar (not shown) may be used to prevent the hex nut and spool sprocket from moving axially on the shaft 38.

Figure 4:
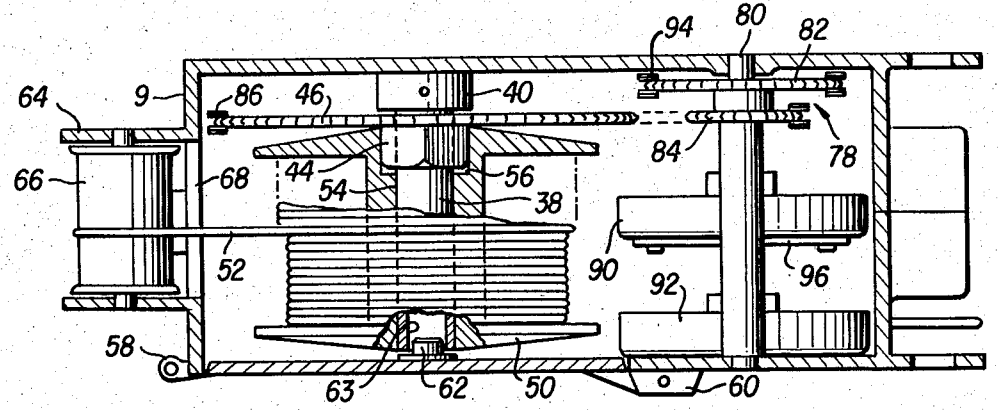
FIG. 4 is a view taken along line IV—IV of FIG. 3, and showing a top view of the interior of the casing.

A main spool cable 50 is formed of cast aluminum and has a wire rope 52 wound thereon. The spool 50 has an axial bore 54 sized so that the spool can rotatably fit on the shaft 38 with the shaft extending through the bore 54. One end of the bore 54 terminates in a hex shaped enlargement 56 into which the hex nut 44 can fit. Therefore, when in the position shown in FIG. 4, the rotation of the spool also rotates the spool sprocket 46 due to the engagement of the enlargement 56 with the hex nut 54.

A portion of the wall 6 forms an opening which is covered by the hinged door 42. The hinged door 42 is hinged on a vertical axis by the hinges 58, only one of which is shown. The door 42 is sized and positioned so that the spool 50 can be inserted through the opening defined by the door when the door is opened, and onto the spool shaft 38, and can also be removed with the door open. The door is normally held shut by a door latch 60, which can include a pin lock of a conventional design. A boss 62 on the inner wall of the door 42 fits in a recess 63 of the shaft 38 and supports the end of the shaft 38.

A pair of flanges 64 extend from the top of the end wall 9 and define journals for rotatably supporting a roller spool 66. The roller spool acts as a guide for the cable 52. A recess 68 at the top of the end wall 9 extends to the open area at the top of the casing and provides access for the wire cable to the roller spool without the cable contacting the end wall 9.

The cable 52 terminates in a conventional C-latch 70 and is secured to the cable 52 by the end of the cable being looped and clamped at 72 to form a thimble 74 extending around the latch 70. A safety belt harness 76 of a conventional design may be secured to the C-latch.

Within the casing are also positioned a compound sprocket 78 keyed on a shaft 80 journaled in the sides 4 and 6 of the casing. The compound sprocket includes a large sprocket wheel 82 and a small sprocket wheel 84. The small sprocket wheel is rotatably connected to the spool sprocket 46 via a chain 86.

Figure 3:
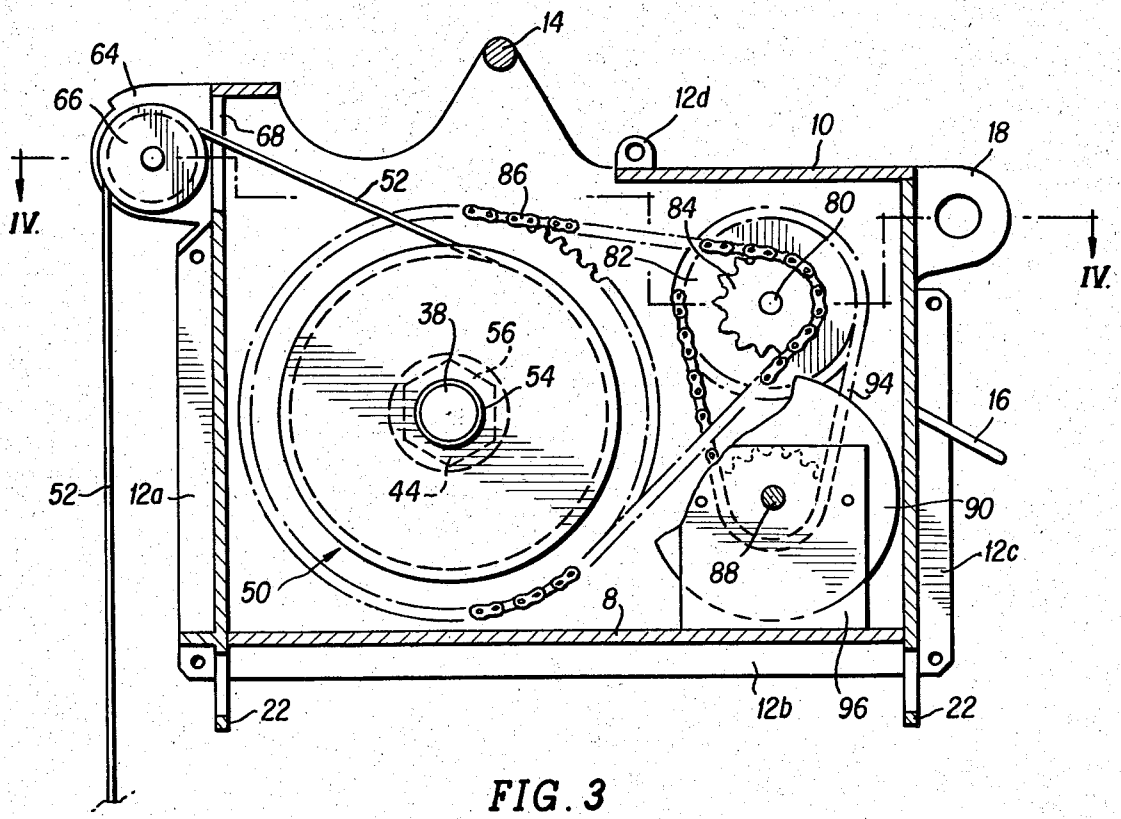
FIG. 3 is a sectional view taken along line III—III of FIG. 2, and showing the spool, sprockets, chains and brakes.

As best seen in FIG. 3, a brake shaft 88 is also provided in the casing parallel to, and below, the compound sprocket shaft 80. The brake shaft 88 is also journaled in the sides 4 and 6 of the casing and has keyed thereto the brake shoes (unnumbered) of the primary and secondary brakes 90 and 92. The brake shaft is driven by the large sprocket 82 via the sprocket chain 94. The stationary brake discs (unnumbered) of the primary and secondary brakes 90 and 92 are non-rotatably fixed relative to the casing. The primary brake 90 is secured to a mounting plate 96 secured to the bottom of the casing, while the secondary clutch disc is secured to the side wall 6 of the casing. The brakes may be of a conventional type, such as the series 400 clutch/brake manufactured by Comet Industries, a division of Hoffco Corporation (Richmond, Indiana). The use of two brakes not only provides a safety factor but minimizes the necessary diameter of the brakes.

The operation of the apparatus described above may be performed as follows:

The escape device is normally stored in a well marked location and includes all of the components described above, as well as additional spools having cables wound thereon and safety belt harnesses. The additional spools and harnesses can be stored in a plastic container attached to the casing, and not shown.

In the event of an emergency which requires escape from the building, the escape device is carried by the handle 14, or the handles 14 and 16, to a window or other opening 100 and the window is opened or broken to gain access to the exterior of the building. After the locking feet 26 and 28 are manually separated with the plungers 36 depressed, the device may be raised by the handles 14 and 16 and positioned with the securement rods 20 extending into the building and the hand grips 24 extending out of the building with the front locking feet 26 engaging an outside surface 102 of the building. Optionally, a block of wood or other support 104 may be positioned on the window sill 106 for initially supporting the escape device.

The rear locking feet are then adjusted so as to firmly press against the inside wall 108 of the building. This is accomplished by first depressing the threaded plungers 36 so that their threads are disengaged from the threads of the threaded rods 32, thus permitting the threaded rods to slide within the rear connecting piece, and so permitting the rapid adjustment of the position of the rear locking feet. When the rear locking feet are approximately in the proper position, the threaded plungers are released and the handles 34 are turned. This causes the rear locking feet to firmly press against the wall 108, and so firmly grip the walls 102 and 108 between the front and rear locking feet. It can be appreciated that a subsequent weight on the wire rope 52 will not tend to dislodge the escape device from the window sill, but will instead more firmly wedge the building walls between the front and rear locking feet.

The escaper will then fit himself into, or be fit into, the safety belt harness 76, and fit the C-clamp 70 to the thimble 74. The escaper will then climb onto the sill, using the handles 14 and 16 as supports. This eliminates the necessity of crawling over the sill using only the sill, which may be littered with broken glass, as a support.

The escaper can then optionally sit on the sill, grip the hand grips 24 and ease himself to a position where he is hanging immediately below the hand grips 24. As such, he will be directly below the roller spool 66. He will also be spaced from the exterior wall 102 of the building since the structure of the present invention provides the hand grip and roller spool extending out from the outer wall 102 (by about 9 inches for the axis of the roller spool). As described above, the weight of the escaper will tend to cause the front and rear locking feet to more securely wedge the building therebetween, thereby assuring security.

When the escaper releases the hand grip, he will begin to descend directly downward at a distance spaced from the building. This will avoid his moving in an arc which can cause him to crash into the building.

As the cable unwinds from the spool, the rotation of the spool 50 rotates the spool sprocket 46. The rotation of the spool sprocket in turn rotates the compound sprocket 78 via the chain 86, and so rotates the brake shaft 88 via the chain 94. The rotating brake shoes which are keyed on the brake shaft 88 frictionally engage the brake disks and limit the descent speed of the escaper.

Once the escaper has reached the ground, anyone remaining in the building can immediately open the door 42 and slide the spool 50 off of the shaft 38. By then lifting the spool up and forward, the end of the wire rope can be disengaged from the roller spool and the spent spool can be thrown on the floor. A fresh spool can then be inserted through the open door and onto the shaft 38 for engagement with the hex nut 44, and its cable looped over the roller spool. The escape process can then be repeated without having to wait for the person who has already escaped to disengage himself from the harness, or for the cable to rewind onto the spool. The escape of several persons using a single apparatus can therefore be rapidly accomplished.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. An escape device comprising:

a casing;

means for securing said casing to a support;

a cylindrical spool rotatably mounted in said casing;

a cable wound on said spool, said cable having one end secured to said spool and a second end having harness attachment means;

brake means operatively connected to said spool for limiting the rotational velocity of said spool; and means for permitting rapid mounting and dismounting of said spool in said casing, whereby said spool can be rapidly replaced by a second spool following an unwinding of said cable from said spool, wherein said casing includes at least first and second opposing walls, and wherein said means for permitting rapid mounting and dismounting comprises:

(a) a first shaft having one end fixed in said first wall and a second end extending toward said second wall, (b) a door in said second wall adjacent said first shaft, said door being sized and shaped to permit passage of said spool, (c) a bore in said spool, said bore being coaxial with the axis of said cylindrical spool and having a diameter sufficient to permit mounting of said spool on said first shaft, and (d) means associated with said first shaft and said spool for rotatably connecting said spool relative to said brake means when said spool is fully mounted on said first shaft, and wherein said means for rotatably connecting said spool relative to said brake means comprise:

(e) a hex shaped enlargement of said bore at one axial end of said cylindrical spool, (f) a hex nut rotatably mounted on said first shaft and fittable in said hex shaped enlargement, (g) a spool sprocket rotatably mounted on said first shaft and fixed to said hex nut, and (h) means rotatably connecting said spool sprocket to said brake means.

2. The escape device of claim 1 wherein said brake means comprise:

a compound sprocket having large and small sprocket wheels and being journalled to said first wall;

a second shaft having ends journalled to said first and second walls;

a brake sprocket fixed to said second shaft;

at least one brake member, each said brake member having brake shoe means fixed to said second shaft and cooperating friction means fixed relative to said casing; and first and second chains respectively rotatably connecting said spool sprocket with said small sprocket and said large sprocket with said brake sprocket, whereby rotation of said spool rotates said brake shoe means while said brake shoe means frictionally engage said friction means.

3. The escape device of claim 2 including two of said brake members.

4. The escape device of claim 2 wherein said means for securing said casing to a support comprises means for securing said casing to a support member having vertical inside and outside walls bridged by a substantially horizontal surface.

5. The escape device of claim 4 wherein one end of said casing includes a roller spool for guiding a portion of said cable which has been unwound from said cylindrical spool and wherein said means for securing said casing comprise:

at least one front locking foot extending downward from said casing when said first shaft axis is oriented horizontally;

two securement rods fixed to said casing and extending from said casing in a horizontal direction opposite said roller spool and transverse to said first shaft axis;

a rear locking foot mounted on each said securement rod; and means for adjustably fixing a position of each said rear locking foot on said securement rod, whereby said escape device may be positioned on said horizontal surface of said support member with said front and rear locking feet respectively engaging said outside and inside walls with said one end and roller spool extending outside of said outside wall.

6. The escape device of claim 5 including at least two hand grips extending outward from said one end of said casing.

7. An escape device comprising:

a casing;

means for securing said casing to a support;

a cylindrical spool rotatably mounted in said casing;

a cable wound on said spool, said cable having one end secured to said spool and a second end having harness attachment means;

brake means operatively connected to said spool for limiting the rotational velocity of said spool;

means for permitting rapid mounting and dismounting of said spool in said casing, whereby said spool can be rapidly replaced by a second spool following an unwinding of said cable from said spool; and at least one additional said spool having an additional said cable wound thereon, wherein said casing includes at least first and second opposing walls, and wherein said means for permitting rapid mounting and dismounting comprise:

(a) a first shaft having one end fixed in said first wall and a second end extending toward said second wall, (b) a door in said second wall adjacent said first shaft, said door being sized and shaped to permit passage of said spool, (c) a bore in said spool, said bore being coaxial with the axis of said cylindrical spool and having a diameter sufficient to permit mounting of said spool on said first shaft, and (d) means associated with said first shaft and said spool for rotatably connecting said spool relative to said brake means when said spool is fully mounted on said first shaft, and wherein said means for rotatably connecting said spool relative to said brake means comprise:

(e) a hex shaped enlargement of said bore at one axial end of said cylindrical spool, (f) a hex nut rotatably mounted on said first shaft and fittable in said hex shaped enlargement, (g) a spool sprocket rotatably mounted on said first shaft and fixed to said hex nut, and (h) means rotatably connecting said spool sprocket to said brake means.

8. The escape device of claim 7 wherein said brake means comprise:

a compound sprocket having large and small sprocket wheels and being journalled to said first wall;

a second shaft having ends journalled to said first and second walls;

a brake sprocket fixed to said second shaft;

at least one brake member, each said brake member having brake shoe means fixed to said second shaft and cooperating friction means fixed relative to said casing; and first and second chains respectively rotatably connecting said spool sprocket with said small sprocket and said large sprocket with said brake sprocket, whereby rotation of said spool rotates said brake shoe means while said brake shoe means frictionally engage said friction means.

9. The escape device of claim 8 including two of said brake members.

10. The escape device of claim 7 wherein said means for securing said casing to a support comprises means for securing said casing to a support member having vertical inside and outside walls bridged by a substantially horizontal surface.

11. The escape device of claim 7 wherein one end of said casing includes a roller spool for guiding a portion of said cable which has been unwound from said cylindrical spool and wherein said means for securing said casing comprise:

at least one front locking foot extending downward from said casing when said first shaft axis is oriented horizontally;

at least two securement rods fixed to said casing and extending from said casing in a horizontal direction opposite said roller spool and transverse to said first shaft axis;

a rear locking foot mounted on each said securement rod; and means for adjustably fixing a position of each said rear locking foot on said securement rod, whereby said escape device may be positioned on said horizontal surface of said support member with said front and rear locking feet respectively engaging said outside and inside walls with said one end and roller spool extending outside of said outside wall.

12. The escape device of claim 11 including at least two hand grips extending outward from said one end of said casing.

13. An escape device comprising:

a casing;

means for securing said casing to a support;

a cylindrical spool rotatably mounted in said casing;

a cable wound on said spool, said cable having one end secured to said spool and a second end having harness attachment means;

at least two hand grips extending outward from said one end of said casing;

brake means operatively connected to said spool for limiting the rotational velocity of said spool;

means for permitting rapid mounting and dismounting of said spool in said casing, whereby said spool can be rapidly replaced by a second spool following an unwinding of said cable from said spool, wherein said casing includes at least first and second opposing walls, and wherein said means for permitting rapid mounting and dismounting comprise:

(a) a first shaft having one end fixed in said first wall and a second end extending toward said second wall, (b) a door in said second wall adjacent said first shaft, said door being sized and shaped to permit passage of said spool, (c) a bore in said spool, said bore being coaxial with the axis of said cylindrical spool and having a diameter sufficient to permit mounting of said spool on said first shaft, and (d) means associated with said first shaft and said spool for rotatably connecting said spool relative to said brake means when said spool is fully mounted on said first shaft, wherein said means for securing said casing to a support comprises means for securing said casing to a support member having vertical inside and outside walls bridged by a substantially horizontal surface, wherein one end of said casing includes a roller spool for guiding a portion of said cable which has been unwound from said cylindrical spool and wherein said means for securing said casing comprise:

(e) at least one front locking foot extending downward from said casing when said first shaft axis is oriented horizontally, (f) at least two securement rods fixed to said casing and extending from said casing in a horizontal direction opposite said roller spool and transverse to said first shaft axis, (g) a rear locking foot mounted on each said securement rod, and (h) means for adjustably fixing a position of each said rear locking foot on said securement rod, whereby said escape device may be positioned on said horizontal surface of said support member with said front and rear locking feet respectively engaging said outside and inside walls with said one end and roller spool extending outside of said outside wall, and wherein said means for adjustably fixing a position of each said rear locking foot comprises:

(i) a threaded shaft rotatably mounted in each said rear locking foot, (j) means for rotating said threaded shaft, (k) threaded guide means fixed to said support rod and having threads engageable with said threaded rod, and (1) means for selectively disengaging said threads of said guide means from said threaded rod.

* * * * *